US008960461B2

(12) United States Patent
Kakeya et al.

(10) Patent No.: US 8,960,461 B2
(45) Date of Patent: Feb. 24, 2015

(54) CRANE EQUIPPED WITH TRAVELABLE COUNTERWEIGHT UNIT

(71) Applicant: Kobelco Cranes Co., Ltd., Shinagawa-ku (JP)

(72) Inventors: Mitsuo Kakeya, Akashi (JP); Kazuyuki Miyazaki, Akashi (JP)

(73) Assignee: Kobelco Cranes Co., Ltd., Shinagawa-ku (JP)

( * ) Notice: Subject to any disclaimer, the term of this patent is extended or adjusted under 35 U.S.C. 154(b) by 0 days.

(21) Appl. No.: 13/661,546

(22) Filed: Oct. 26, 2012

(65) Prior Publication Data

US 2013/0105429 A1 May 2, 2013

(30) Foreign Application Priority Data

Nov. 1, 2011 (JP) ..... 2011-240196

(51) Int. Cl.
*B66C 23/76* (2006.01)
*B66C 23/74* (2006.01)

(52) U.S. Cl.
CPC ..... *B66C 23/74* (2013.01)
USPC ..... 212/198; 212/195; 212/279; 280/755; 701/41

(58) Field of Classification Search
USPC ..... 212/276, 279, 282, 283, 195–198; 280/755; 701/41, 42, 50
See application file for complete search history.

(56) References Cited

U.S. PATENT DOCUMENTS 1,716,732 A * 6/1929 Mossay ..... 212/301
3,842,984 A * 10/1974 Brown et al. ..... 212/195
3,930,583 A * 1/1976 Jouffray ..... 212/195
4,243,148 A * 1/1981 Lampson ..... 212/196
4,258,852 A * 3/1981 Juergens ..... 212/178

(Continued)

FOREIGN PATENT DOCUMENTS

JP 2-5665 2/1990
JP 9-272457 A 10/1997

(Continued)

OTHER PUBLICATIONS

Combined Chinese Office Action and Search Report issued Mar. 20, 2014 in Patent Application No. 201210431129.9 (with English translation of the Office Action and English translation of categories of cited documents).

*Primary Examiner* — Emmanuel M Marcelo
*Assistant Examiner* — Michael Gallion
(74) *Attorney, Agent, or Firm* — Oblon, Spivak, McClelland, Maier & Neustadt, L.L.P.

(57) ABSTRACT

Disclosed is a crane comprising: a lower body; an upper slewing body; a counterweight unit including a plurality of wheels to travel on the ground in a turning direction equal to a slewing direction of the upper slewing body while being suspended from the upper slewing body; a steering actuator for rotating each of the wheels around a steering-rotation center axis to change the steering angle; and a steering control device for controlling the steering actuator. The steering control device includes: a slewing-identification-signal receiving section which receives a slewing identification signal for identification of the slewing direction of the upper slewing body; and an actuator operating section operates the steering actuator to orient each of the wheels to the inside of a tangent line to an orbit of the wheel at the steering-rotation center axis, based on the identified slewing direction identified from the slewing identification signal.

15 Claims, 9 Drawing Sheets

(56) References Cited

U.S. PATENT DOCUMENTS

| | | | | | |
|---|---|---|---|---|---|
| 4,268,216 | A | * | 5/1981 | Copie | 414/719 |
| 4,316,548 | A | * | 2/1982 | Helm et al. | 212/196 |
| 4,349,115 | A | * | 9/1982 | Lampson | 212/178 |
| 4,502,709 | A | * | 3/1985 | Schaeff | 280/758 |
| 4,540,097 | A | * | 9/1985 | Wadsworth et al. | 212/196 |
| 4,683,825 | A | * | 8/1987 | Moskowitz | 105/148 |
| 4,711,358 | A | * | 12/1987 | Konishi | 212/178 |
| 4,716,728 | A | * | 1/1988 | Kakeya | 60/426 |
| 4,716,729 | A | * | 1/1988 | Kakeya | 60/426 |
| 4,763,800 | A | * | 8/1988 | Engler et al. | 212/195 |
| 4,788,820 | A | * | 12/1988 | Sakai et al. | 60/444 |
| 5,941,401 | A | * | 8/1999 | Petzold et al. | 212/178 |
| 6,039,194 | A | * | 3/2000 | Beeche et al. | 212/301 |
| 6,338,022 | B1 | * | 1/2002 | Shinmura et al. | 701/301 |
| 8,528,755 | B2 | * | 9/2013 | Kurotsu | 212/196 |
| 2002/0076279 | A1 | * | 6/2002 | Quenzi et al. | 404/100 |
| 2005/0011849 | A1 | * | 1/2005 | Chattey | 212/270 |
| 2005/0236223 | A1 | * | 10/2005 | Yokota | 180/446 |
| 2010/0116766 | A1 | * | 5/2010 | Pech | 212/196 |
| 2013/0116891 | A1 | * | 5/2013 | Hayama | 701/42 |

FOREIGN PATENT DOCUMENTS

| | | | |
|---|---|---|---|
| JP | 2895434 | | 3/1999 |
| JP | 2895437 | | 3/1999 |
| JP | 2001-347975 | A | 12/2001 |

* cited by examiner

CRANE EQUIPPED WITH TRAVELABLE COUNTERWEIGHT UNIT

BACKGROUND OF THE INVENTION

1. Field of the Invention

The present invention relates to a crane equipped with a unit having a plurality of wheels and capable of traveling on the ground in a turning direction.

2. Description of the Background Art

Heretofore, there has been known a crane equipped with a travelable counterweight unit, as described, for example, in Patent Documents: JP 2895434B, JP 2895437B and JP 02-005665B. This counterweight unit is suspended, for example, from a mast of the crane. In this state, accompanying a slewing movement of an upper slewing body of the crane, the counterweight unit can travel on the ground with respect to a direction of the slewing movement. Meanwhile, in a situation where the crane is operated to lift up a suspended load of a predetermined mass or more, the counterweight unit is floated up from the ground.

In many cases, the above type of counterweight unit is connected to the upper slewing body of the crane, through a connection member. In one example shown in FIG. 9B, the counterweight unit 90 is connected through a connection member 92 to an upper slewing body 91 of a crane, specifically, joined to the connection member 92 through a pin so as to be inclinable with respect to the ground. In another example shown in FIG. 9C, the counterweight unit 90 is connected through two connection members 92 to the upper slewing body 91 at respective two upper and lower positions, thus being restrained so as to be precluded from inclination to the ground. Alternatively, there can be some cases where the counterweight unit 90 is not directly connected to the upper slewing body 91.

Any of the above counterweight units is provided with a plurality of wheels, whose orientation is set to a direction aligned with a tangent line to a turning direction of the wheel; however, in fact, a turning radius of the wheel of the counterweight unit is increased, which is likely to cause various disadvantages. Specifically, as shown in FIG. 9A, in the conventional counterweight unit, although the orientation of each of the wheels 94 (a front-rear direction of the wheel) is adjusted to make agreement with a tangent line L1 to an orbit C of the wheel 94, an actual position of the wheel 94 is deviated outwardly from the normal orbit C, i.e., a circular trajectory having a radius r, due to a centrifugal force acting on the counterweight unit being traveling in a turning direction, involving an inadequate increase in a turning radius of the wheel 94. The increase in the turning radius causes the following disadvantages.

Firstly, in the case of the counterweight unit not directly connected to the upper slewing body, the counterweight unit is normally located immediately below a distal end of a mast; however, the increase in the turning radius of the wheel increases a turning radius of the entire counterweight unit, thus displacing the counterweight unit toward a rearward side with respect to the upper slewing body from the position under the distal end of the mast. If, in this state, the crane lifts up a suspended load of a predetermined mass or more to thereby float the counterweight unit from the ground, i.e., release the restraint of the counterweight unit by friction with the ground, the counterweight unit is returned to a position immediately below the distal end of the mast, i.e., a position corresponding to the normal turning radius r, by gravity acting on the counterweight unit. This makes the counterweight unit swing in a direction of the turning radius.

Secondly, in the case of the counterweight unit 90 connected through the connection member 92 to the upper slewing body 91, as shown in FIGS. 9B and 9C, the increase in the turning radius of the wheel 94 cannot vary the turning radius r of a unit body of the counterweight unit 90; however, this case also involves the following disadvantage. In the case of the inclinable counterweight unit 90 as shown in FIG. 9B, the increase in turning radius r of the wheel 94 does not increase the turning radius r of the unit body of the counterweight unit 90, which gives a difference between the turning radius of the unit body of the counterweight unit 90 and the turning radius of the wheel 94, the difference undesirably inclining the entire counterweight unit 90. Particularly, in the case where the wheel 94 is easily deformable such as a pneumatic tire, i.e., a tire to be used in air-filled state, the inclination of the entire counterweight unit 90 is more pronounced. The inclination of the counterweight unit 90 makes respective loads applied to the wheels 94 be ununiform, thereby accelerating wear of the wheel 94 and shortening wheel life. On the other hand, in the case where the counterweight unit 90 is not inclinable as shown in FIG. 9C, the increase in the turning radius of the wheel 94 causes the wheel 94 to undergo a significant shear force to thereby bring the wheel 94 into abnormal deformation. Hence, in this case, damage and wear of the wheel 94 is accelerated, resulting in shortened wheel life.

As means to avoid the above disadvantages, it is conceivable to perform an operation of returning the turning radius of the wheel to an adequate value, for example, an operation of changing the orientation of the wheel from the state shown in FIG. 9A, linearly moving the counterweight unit 90 to an inward side of the orbit C, and thereafter returning the orientation of the wheel to the state shown in FIG. 9A again; however, this operation is complicated and time-consuming, causing deterioration in efficiency of crane operations.

SUMMARY OF THE INVENTION

It is an object of the invention to provide a crane equipped with a counter weight unit including a plurality of wheels to be capable of travelling on the ground in a turning direction, the crane being capable of suppressing an increase in a slewing radius of the wheels to enhance the operation efficiency of the crane.

Provided is a crane comprising: a lower body; an upper slewing body mounted on the lower body so as to be slewable; a counter weight unit including a plurality of wheels each being rollable on the ground and having a variable steering angle, the counter weight unit being capable of travelling on the ground with respective rolling motions of the wheels, in a turning direction equal to a slewing direction of the upper slewing body, in a state of being suspended from the upper slewing body; a steering actuator adapted to rotate the wheels around a steering-rotation center axis to change the steering angle thereof; and a steering control device for controlling an operation of the steering actuator. The steering control device includes a slewing-identification-signal receiving section which receives a slewing identification signal to enable a slewing direction of the upper slewing body to be identified, and an actuator operating section which operates the steering actuator so as to orient the wheels to the inside of a tangent line, on the steering-rotation center axis of the wheels, to an orbit of the counter weight unit, based on the slewing direction identified by the slewing identification signal.

DESCRIPTION OF THE PREFERRED EMBODIMENTS

With reference to FIG. 1 to FIGS. 5A and 5B, a first embodiment of the present invention will be described. FIGS. 4A and 4B are schematic top plan views showing a plurality of wheels of a counterweight unit 30 according to the first embodiment, in respective situations where the counterweight unit 30 is traveling so as to turn clockwise and counterclockwise in top plan view.

Figure 1:
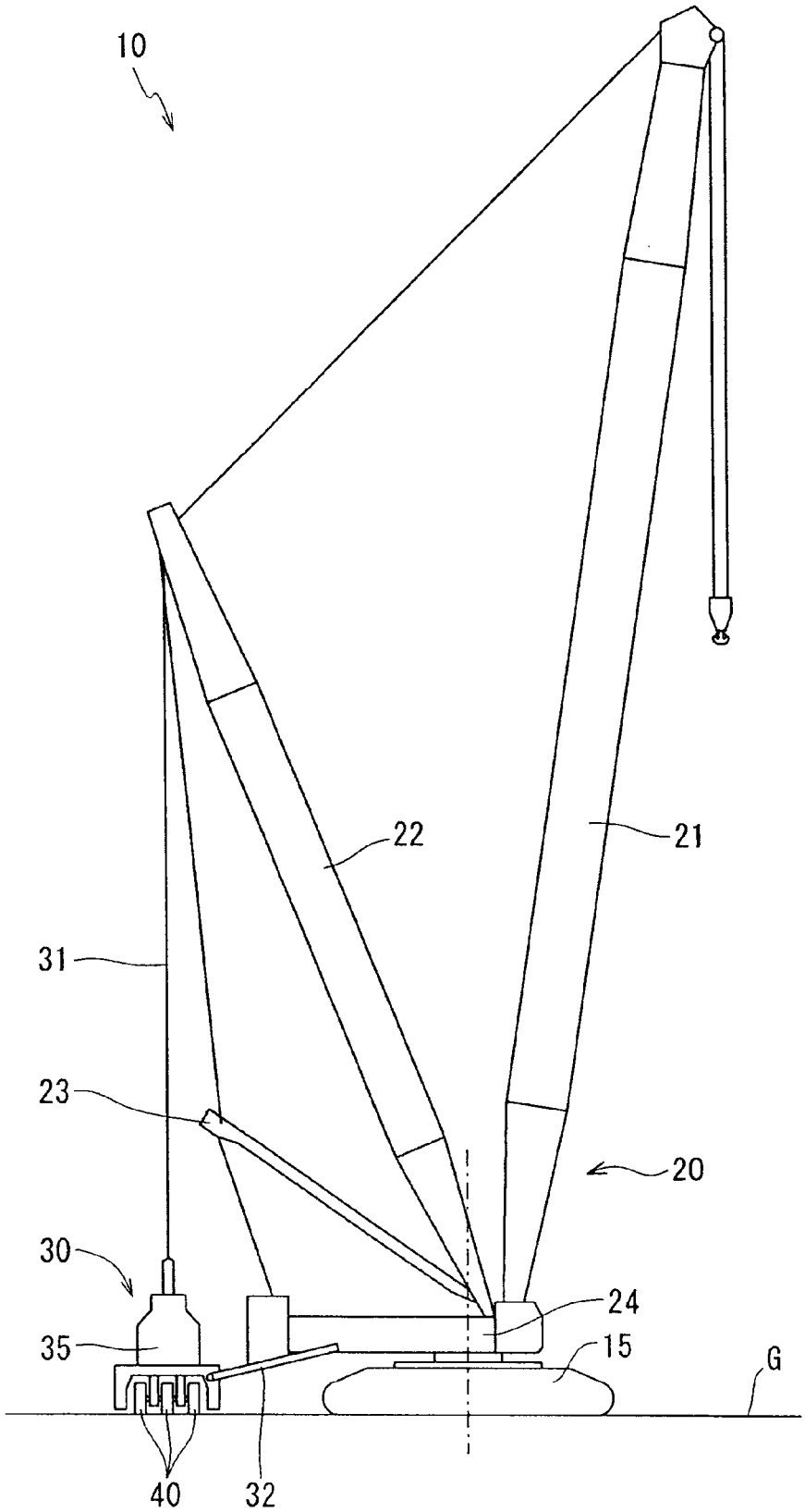
FIG. 1 is an overall view of a crane according to embodiments of the present invention.

FIG. 1 shows a crane 10 equipped with the counterweight 30. This crane 10 is a cargo handling machine for lifting up a suspended load, and may be, for example, a traveling crane or a lattice-boom crawler crane.

Figure 3:
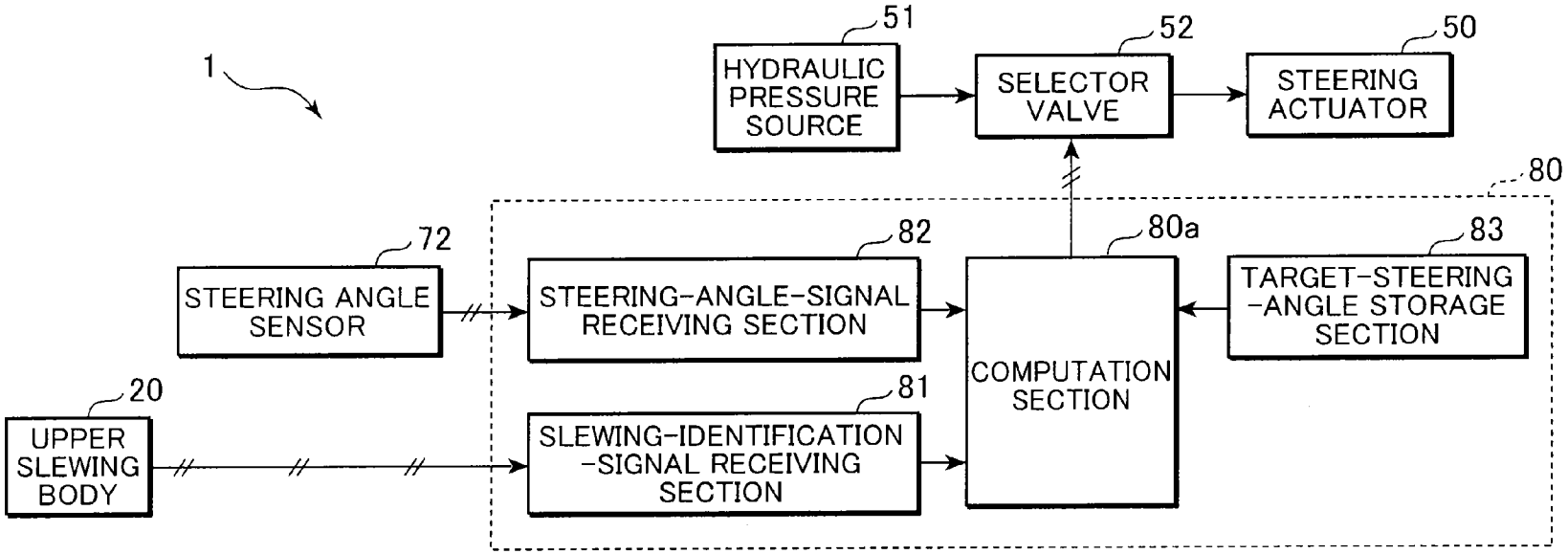
FIG. 3 is a block diagram of a steering control device in the crane according to the first embodiment.

The crane 10 comprises: a lower body 15; and an upper slewing body 20 slewably mounted on the lower body 15 and including a slewable frame 24, a boom 21, a first mast 22 and a second mast 23; a counterweight unit 30 suspended from the upper slewing body 20, for example, from the first mast 22 of the upper slewing body 20; and a steering actuator 50 and a steering control device 1 each shown in FIG. 3. The steering actuator 50 is operated to change a steering angle of the counterweight unit 30, and the steering control device 1 operates the steering actuator 50 so as to control a traveling of the counterweight unit 30, particularly, the steering angle thereof.

The lower body 15 is a part for travelling the crane 10, i.e., a lower propelling body, including, for example, a crawler shown in FIG. 1 or a plurality of wheels. The slewable frame 24 of the upper slewing body 20 is mounted on the lower body 15 so as to be slewable about a vertical slewing center axis O1 shown in FIG. 2, and the boom 21, the first mast 22 and the second mast 23 are attached to the slewable frame 24 in a raisable and lowerable manner, being arranged in this order from a front side of the slewable frame 24. The boom 21 is a structural member for suspending a load through a wire rope, having, for example, a lattice structure. The first mast 22 is a structural member for raising and lowering the boom 21 through a wire rope or a guy line, having, for example, a lattice structure. The second mast 23 is a member for raising and lowering the first mast 22 through a guy line or the like, having, for example, a box-shaped structure.

The counterweight unit 30 is a dead-weight member for cancelling a gravitational moment acting on a load suspended by the crane 10, the moment intending to incline the crane 10 frontward, to enhance a lifting capability of the crane 10. The counterweight unit 30 is suspended from a distal end of the first mast 22 through a hanger rope 31 and adapted to touch down the ground G when the boom 21 suspends a load having a mass less than a predetermined value (including a situation where no load is suspended) and to be floated from the ground G when the mass of the suspended load is equal to or greater than the predetermined value.

The counterweight unit 30 is capable of traveling on the ground G, accompanying the slewing of the upper slewing body 20 with respect to the lower body 15, in a turning direction corresponding to the direction of the slewing while touching down the ground G, as described below. Specifically, the counterweight unit 30 comprises a unit body 35, and a plurality of wheels 40 rotatably attached to the unit body 35. The wheels 40 are adapted to roll on the ground G to enable the counterweight unit 30 to travel.

Figure 2:
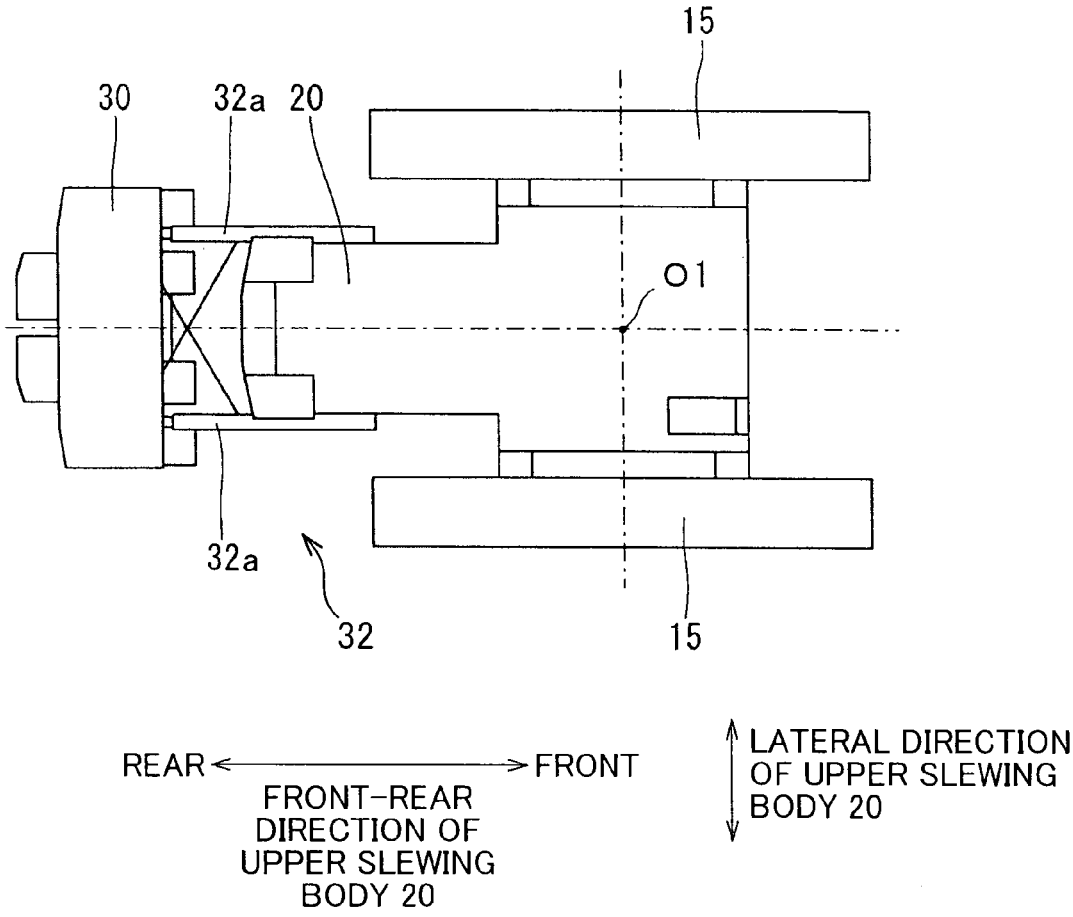
FIG. 2 is a top plan view primarily showing an upper slewing body and a counterweight unit in the crane in FIG. 1.

The counterweight unit 30 is connected to the upper slewing body 20 through a unit-body connection member 32. The unit-body connection member 32 interconnects the counterweight unit 30 (specifically, the unit body 35) and the upper slewing body 20 to keep a distance therebetween constant or approximately constant. The unit-body connection member 32 may be, for example as shown in FIG. 2, composed of two rod-shaped members 32*a* protruding from respective right and left lateral surfaces of the upper slewing body 20 toward a rearward side with respect to the upper slewing body 20, as shown in FIG. 2, or it may be one rod-shaped member, or a member having any suitable shape other than a rod shape. The unit-body connection member 32 and the unit body 35 may be interconnected, for example as shown in FIG. 1, at a single position by means of pin connection so as to allow the unit body 35 to be inclined to the ground G, or may be interconnected at least at upper and lower positions by means of pin connection so as to preclude the unit body 35 from inclination to the ground G, for example, as shown in FIG. 9C. Alternatively, the unit-body connection member 32 may be omitted.

Figure 4A:
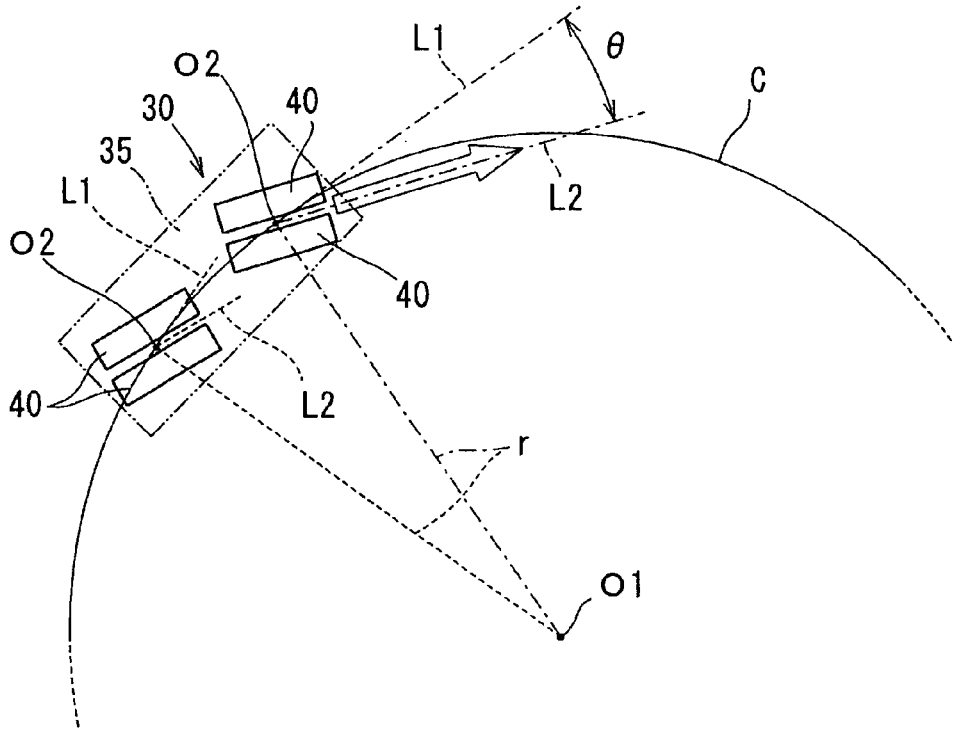
FIGS. 4A and 4B are schematic top plan views showing a plurality of wheels of the counterweight unit in the crane shown in FIG. 1.
Figure 4B:
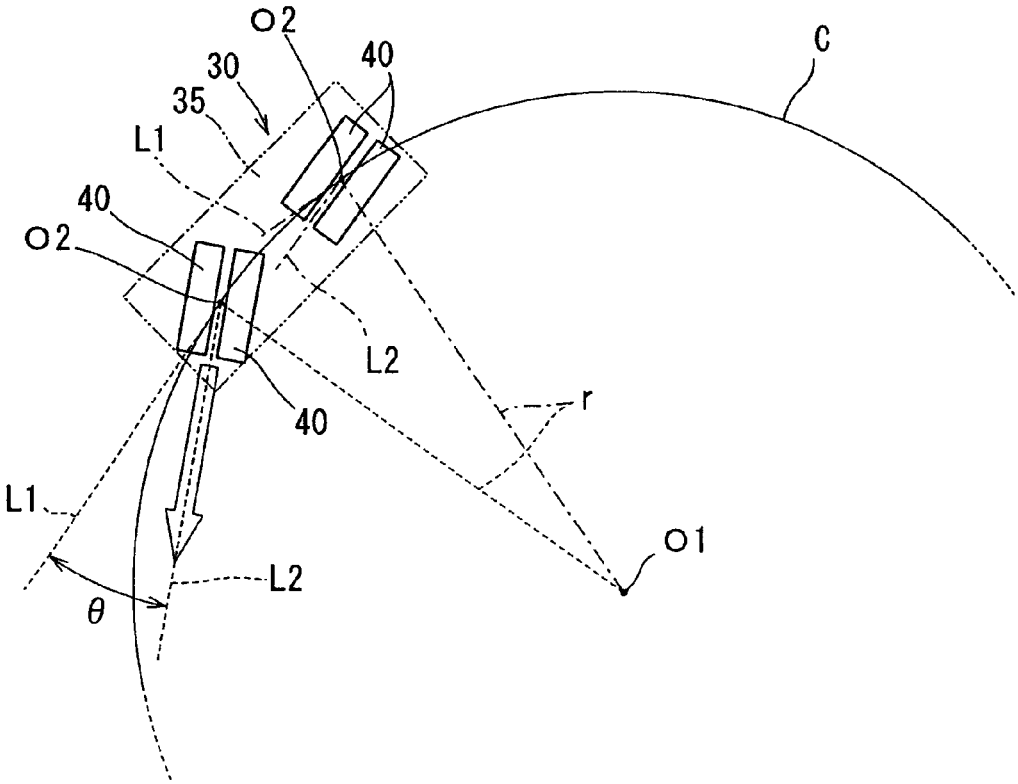

Each of the wheels 40 is formed of a rubber tire to be used in air-filled state, namely, a pneumatic tire, and rotatably attached to the unit body 35 so as to enable the counterweight unit 30 to turn to travel (to travel in a turning direction). The wheels 40 are provided at respective positions, for example, four positions as shown in FIGS. 4A and 4B, in a lower end portion of the unit body 35. The wheels 40 are preferably arranged in a plurality of rows (for example, FIG. 1 showing three rows, FIGS. 4A, 4B showing two rows) aligned in the front-rear direction of the upper slewing body 20 shown in FIG. 2, that is, a direction approximately along with the slewing radius r, and in a plurality of rows (for example, FIGS. 4A, 4B showing two rows) aligned in a width direction of the upper slewing body 20, that is, a direction approximately along with a turning orbit C specifically described below. The following explanation is predicated on the arrangement of the wheels 40 shown in FIGS. 4A, 4B, except where especially noted.

The wheels 40 arranged in the front-rear direction of the upper slewing body 20 are adapted to be steered so as to be integrally rotated about a common vertical steering-rotation center axis O2. Meanwhile, the wheels 40 also can be designed to be individually steered. Alternatively, three or more of the wheels 40 may be integrally steered.

The steering actuator 50 is attached to the unit body 35 while being connected to each of the wheels 40 to rotate the wheels 40 about the steering-rotation center axis O2 so as to change a steering angle θ of the wheel 40. The steering actuator 50 according to the first embodiment is a hydraulic actuator operable to be driven by hydraulic pressure from a hydraulic pressure source 51, formed of, for example, a hydraulic cylinder or a hydraulic motor.

The steering control device 1 is designed to operate the steering actuator 50 so as to control the steering angle θ of the wheels 40 based on a slewing direction of the upper slewing body 20, as indicated by the arrows in FIGS. 4A and 4B. As to the steering control device 1, all components or elements thereof may be installed within the counterweight unit 30, or a part of the components or elements may be installed to other location such as the upper slewing body 20.

As shown in FIG. 3, the steering control device 1 comprises: a hydraulic pressure source 51 for supplying hydraulic pressure to the steering actuator 50, a selector valve 52 disposed between the hydraulic pressure source 51 and the steering actuator 50, a computation and control unit 80 connected to the selector valve 52 to operate the selector valve 52, and a steering angle sensor 72 operable to detect the steering angle θ of the wheel 40.

In the first embodiment, the steering angle θ is an angle defined between a tangent line L1 to a circular orbit C of the counterweight unit 30 as shown in FIGS. 4A and 4B and a half line L2 extending from the steering-rotation center axis O2 toward a frontward side of the wheel 40 along a front-rear direction of the wheel 40. The steering actuator 50 makes operation, depending on a selected position of the selector valve 52, so as to change the steering angle θ of the wheel 40, or stop the operation.

The selector valve 52, having a plurality of positions to be selected, is adapted to switch the operation of the steering actuator 50 upon the change of the selected position thereof by an electric signal (or a hydraulic pressure signal or the like) input from the computation and control device 80. Specifically, the selector valve 52 switches allowance/prevention of the supply of the hydraulic fluid from the hydraulic pressure source 51 to the steering actuator 50 and switches a direction of the supply.

The steering angle sensor 72 may be a type of directly detecting the steering angle θ of the wheel 40, or may be a type of detecting a parameter based on which the steering angle θ is calculated, such as expansion-retraction position or a rotational position of the steering actuator 50. The steering angle sensor 72 produces a steering angle signal which is a signal on information indicative of or equivalent to the steering angle θ and inputs the steering angle signal into the computation and control unit 80.

The computation and control unit 80 is designed to receive respective inputs of various information signals and control the operation of the steering actuator 50 based on the received signals. The computation and control unit 80 may be installed in the counterweight unit 30 shown in FIG. 1, or may be installed to other location such as the upper slewing body 20.

The computation and control unit 80 comprises a computation section 80*a*, a slewing-identification-signal receiving section 81, a steering-angle-signal receiving section 82, and a target-steering-angle storage section 83, as shown in FIG. 3. The slewing-identification-signal receiving section 81 receives a slewing identification signal for identifying the slewing direction of the upper slewing body 20 (the direction indicated in FIG. 4A or the direction indicated in FIG. 4B). The slewing identification signal according to the first embodiment is output from the upper slewing body 20, and the slewing-identification-signal receiving section 81 is connected to the upper slewing body 20 through an electric line to receive the slewing identification signal. The slewing identification signal, i.e., a signal for identifying the slewing direction of the upper slewing body 20, may be an electric signal to be produced based on a lever operation by an operator of the crane 10 shown in FIG. 1 or to be converted from a hydraulic signal based on the lever operation, or may be an electric signal to be converted from a hydraulic pressure for driving a hydraulic motor for slewing the upper slewing body 20. The steering-angle-signal receiving section 82 receives the steering angle signal produced by the steering angle sensor 72, i.e., an information signal indicative of information about an actual steering angle θ of the wheel 40. Concerning the steering angle θ of the wheel 40, the target-steering-angle storage section 83 stores therein a target steering angle $\theta_0$ which is an "adequate steering angle" predetermined correspondingly to each of the slewing directions of the upper slewing body 20.

The steering control device 1 makes the following operation. The computation and control unit 80 controls the steering actuator 50 so as to bring the actual steering angle θ of the wheel 40 into agreement with the target steering angle $\theta_0$ stored in the target-steering-angle storage section 83. Specifically, the computation and control unit 80 controls the operation of the steering actuator 50 shown in FIG. 3 so as to orient the wheel 40 to the inside of the tangent line L1 to the orbit C of the wheel 40 at the position of the wheel 40, in top plan view, as shown in FIGS. 4A and 4B.

Details of the operation are as follows. Upon a lever operation, by an operator of the crane 10 shown in FIG. 1, for slewing the upper slewing body 20, the slewing identification signal, i.e., an electric signal indicative of information for enabling the actual slewing direction of the upper slewing body 20 to be identified, is input from the upper slewing body 20 into the slewing-identification-signal receiving section 81, as shown in FIG. 3. The computation section 80*a* reads, from the target-steering-angle storage section 83, the target steering angle $\theta_0$ associated with the slewing direction identified based on the slewing identification signal received by the slewing-identification-signal receiving section 81. Concurrently, the steering angle signal produced by the steering angle sensor 72, i.e., a detection result on an actual steering angle θ of the wheel 40, is input into the computation section 80*a* via the steering-angle-signal receiving section 82.

The computation section 80*a* outputs to the selector valve 52 an instruction for switching the selected position of the selector valve 52 so as to bring the actual steering angle θ into agreement with the target steering angle $\theta_0$. Since the steering actuator 50 is operated, depending on the selected position of the selector valve 52, to change the steering angle θ of the wheel 40, the computation section 80*a* can control the steering angle θ by switching the selected positions of the selector valve 52. The computation section 80*a* thus makes up an "actuator operating section" which operates the steering actuator 50, incorporation with the selected valve 52. The change of the steering angle θ is performed in concurrence with the slewing of the upper slewing body 20 and the travel of the counterweight unit 30 in a direction of the slewing. Upon the agreement of the actual steering angle θ of the wheel 40 with the target steering angle $\theta_0$, the computation and control unit 80 stops the operation of the steering actuator 50.

The timing of starting the slewing of the upper slewing body 20 and the timing of starting and finishing the change of the steering angle θ of the wheel 40 may be variously determined. For example, the change of the steering angle θ of the wheel 40 may be started followed by the slewing of the upper slewing body 20. It is also possible to actually start the slewing of the upper slewing body 20 upon the agreement of the steering angle θ of the wheel 40 with the target steering angle $\theta_0$.

Specifically, the computation and control unit 80 operates the steering actuator 50 so as to orient the wheel 40 to the inside of the tangent line L1 to the orbit C of the wheel 40 at the position of the wheel 40, specifically, at the position of the steering-rotation center axis O2 of the wheel 40, in top plan view, as shown in FIGS. 4A and 4B, preferably, so as to make all of the wheels 40 provided in the counterweight unit 30 satisfy the above condition. In this condition, the "position of the steering-rotation center axis O2 of the wheel 40" means as follows: in the case where the two or more wheels 40 (in FIGS. 4A and 4B, the two wheels 40) are integrally rotated about a common steering-rotation center axis O2, the position of the steering-rotation center axis O2 corresponds to a position of the common steering-rotation center axis O2 of the wheels; in the case where the two or more wheels 40 are steered individually, the position of the steering-rotation center axis O2 corresponds to a steering-rotation center axis for each of the wheels. Furthermore, the "orbit C of the wheel 40" means a circle having a center at the slewing center axis O1 of the upper slewing body 20 shown in FIG. 2 and passing through the steering-rotation center axis O2, that is, a circular orbit. Besides, a line segment interconnecting the slewing center axis O1 and the steering-rotation center axis O2 corresponds to the turning radius r of the wheel 40. "The wheel 40 is oriented to the inside of the tangent line L1" means that a front portion of the wheel 40 in the front-rear direction thereof (a front side of the wheel 40 approximately in a traveling direction thereof) is oriented toward the slewing center axis O1 with respect to the tangent line L1, that is, the half line L2 is oriented toward the slewing center axis O1 with respect to the tangent line L1.

A specific value of the target steering angle $\theta_0$ is determined based on preliminary researches and studies. For example, it is possible to perform experiment and analysis to find out the steering angle θ which allows the turning radius r of the wheel 40 to be kept constant, irrespective of a centrifugal force acting on the counterweight unit 30 during turning traveling of the counterweight unit 30 and set the found angle θ as the target steering angle $\theta_0$. The experiment and analysis are preferably performed under the condition of no suspended load, that is, the condition of a maximized load imposed on the wheel 40.

Figure 5A:
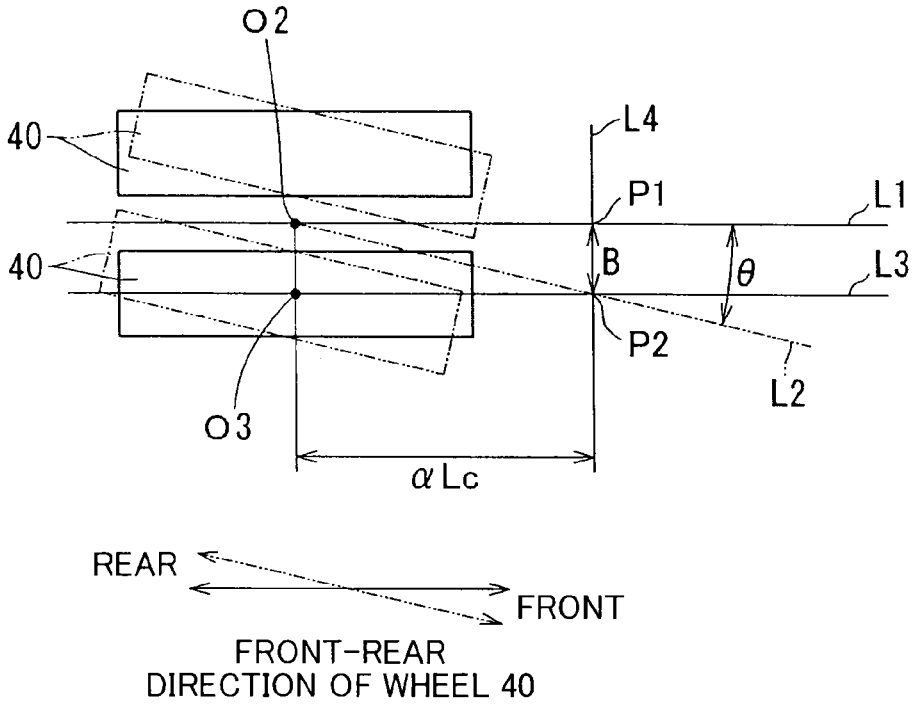
FIG. 5A is a top plan view showing paired ones of the wheels of the counterweight unit.
Figure 5B:
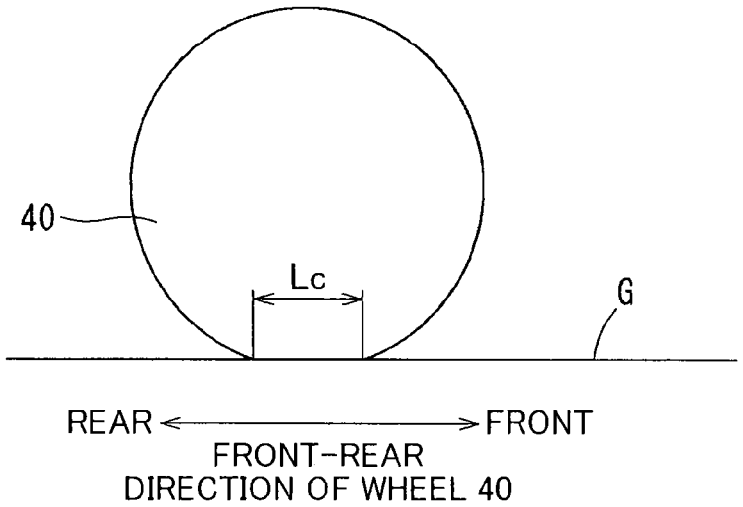
FIG. 5B is a side view of the paired wheels when viewed in a wheel axis direction.

The target steering angle $\theta_0$ may be determined, for example, based on a ground contact length Lc of the wheel 40 shown in FIG. 5B. The ground contact length Lc is a length, in the front-rear direction of the wheel 40, of a portion of the wheel 40 in contact with the ground G. For example, the target steering angle $\theta_0$ is set to a smaller value as the ground contact length Lc becomes larger. More specifically, in top plan view shown in FIG. 5A, the target steering angle $\theta_0$ may be set in the following manner.

(1) Setting of First Reference point P1

As shown in FIG. 5A, a point which lies on the tangent line L1 and is advance of the steering-rotation center axis O2 of the wheel 40 in the front-rear direction of the wheel 40 by a distance of a "coefficient α"×the "ground contact length Lc" is set as a first reference point P1. The coefficient α can be set to various values, for example, in the range of 1.3 to 1.5, or to 1.5.

(2) Setting Auxiliary Line L3

A straight line which is parallel to the tangent line L1 and distant from the tangent line L1 by a distance B inwardly of the orbit C shown in FIGS. 4A and 4B is set as an auxiliary line L3. The distance B is a certain length determined based on an arrangement of the plurality of wheels 40, dimensions of each of the wheels 40, etc. For example, in the case of integrally steering the two wheels 40 about the steering-rotation center axis O2, there can be set as the distance B a distance between the steering-rotation center axis O2 and a center O3 of one of the wheels 40 located at the inside of the orbit C in top plan view.

(3) Setting of Second Reference point P2

A point of intersection between a straight line L4 and the auxiliary line L3 is set as a second reference point P2, the line L4 passing through the first reference point P1 and orthogonally crossing the tangent line L1.

(4) Setting of Target Steering Angle $\theta_0$

A steering angle which allows the half line L2 extending from the steering-rotation center axis O2 of the wheel 40 toward a frontward side in the front-rear direction of the wheel 40 to pass through the second reference point P2 is set as a target steering angle $\theta_0$. For example, a specific value of the target steering angle $\theta_0$ is set in the range of 0.5 to 1.5 degrees, or to 1 degree. FIG. 5A indicates the wheels 40 in such a posture that the front-rear direction thereof is parallel to the tangent line L1, that is, the wheels 40 before correction of the steering angle θ, by the solid line, and indicates the wheel 40 after correction of the steering angle θ by the two-dot chain line.

The above device is able to deter the turning radius r of the wheel 40 from being greater than a normal turning radius during turning traveling of the counterweight unit 30 by controlling the steering angle θ of each of the wheels 40 to orient the half line L2 indicating an orientation of the wheel 40 to the inside of the tangent line L1 to the orbit C, thus hindering disadvantages due to the increase in the turning radius. Besides, it is possible to eliminate or simplify an operation of restoring the increased turning radius r to its original state, thereby allowing the operation efficiency of the crane 10 to be enhanced.

Specifically, the suppression of an increase in the turning radius r of the wheel 40 produces the following advantageous effects.

(a) In the case of the counterweight unit 30 connected to the upper slewing body 20 through the unit-body connection member 32 so as to be inclinable to the ground G, as shown in FIG. 1, the inclination of the counterweight unit 30 with respect to the ground G due to the increase in the turning radius r can be suppressed. This makes it possible to suppress an imbalance of respective loads applied to the wheels 40 or deformation of the wheel 40 due to the inclination, resulting in an extended life of the wheel 40.

(b) In the case of the counterweight unit 30 connected to the upper slewing body 20 through the unit-body connection member 32 so as to preclude the counterweight unit 30 from inclination to the ground G, for example, in the case where the connection is achieved by use of a plurality of members arranged side-by-side in upper and lower relation as shown in FIG. 9C, the deformation of the wheel 40 due to the increase in the turning radius can be suppressed. Hence, also in this case, the life of the wheel 40 can be proved.

(c) In the case of the counterweight unit 30 not directly connected to the upper slewing body 20, the counterweight unit 30 can be hindered from swing in a direction of the turning radius when the counterweight unit 30 is floated from the ground G under the condition of increased turning radius of the counterweight unit 30.

Furthermore, the computation and control unit 80 according to the first embodiment shown in FIG. 3, including the target-steering-angle storage section 83 which stores therein a target steering angle $\theta_0$ pre-determined as an adequate steering angle of the wheel 40 correspondingly to each of the slewing direction of the upper slewing body 20 and adapted to control the steering actuator 50 so as to bring the actual steering angle θ of the wheel 40 into agreement with the target steering angle $\theta_0$, can perform a control simplified and improved in a response speed of steering control of the wheel 40, as compared with the case of calculating an adequate steering angle θ of the wheel 40 during turning operation on a real-time basis.

Besides, the signal to be input into the slewing-identification-signal receiving section 81 of the computation and control unit 80, being an electric signal output from the upper slewing body 20, has an advantage of being applicable to an embodiment of rotationally driving none of the wheels 40 configuration such as a third embodiment which will be described below.

Next will be described a steering control device 101 according to a second embodiment of the present invention with reference to FIG. 6. While the steering control device 1 in the first embodiment shown in FIG. 3 controls the steering angle of the wheel 40 when a signal for slewing the upper slewing body 20 is input into the computation and control unit 80, the steering control device 101 in the second embodiment is configured to control the steering angle of the wheel 40 when the increase in the turning radius r of the wheel 40 is detected. This difference will be described in more detail. In the second embodiment, and aftermentioned third and fourth embodiments, the lower body 15, the upper slewing body 20, the counterweight unit 30 and the steering actuator 50 each described in the crane 10 according to the first embodiment are used as common components; therefore, their duplicated description will be omitted in the following.

Figure 6:
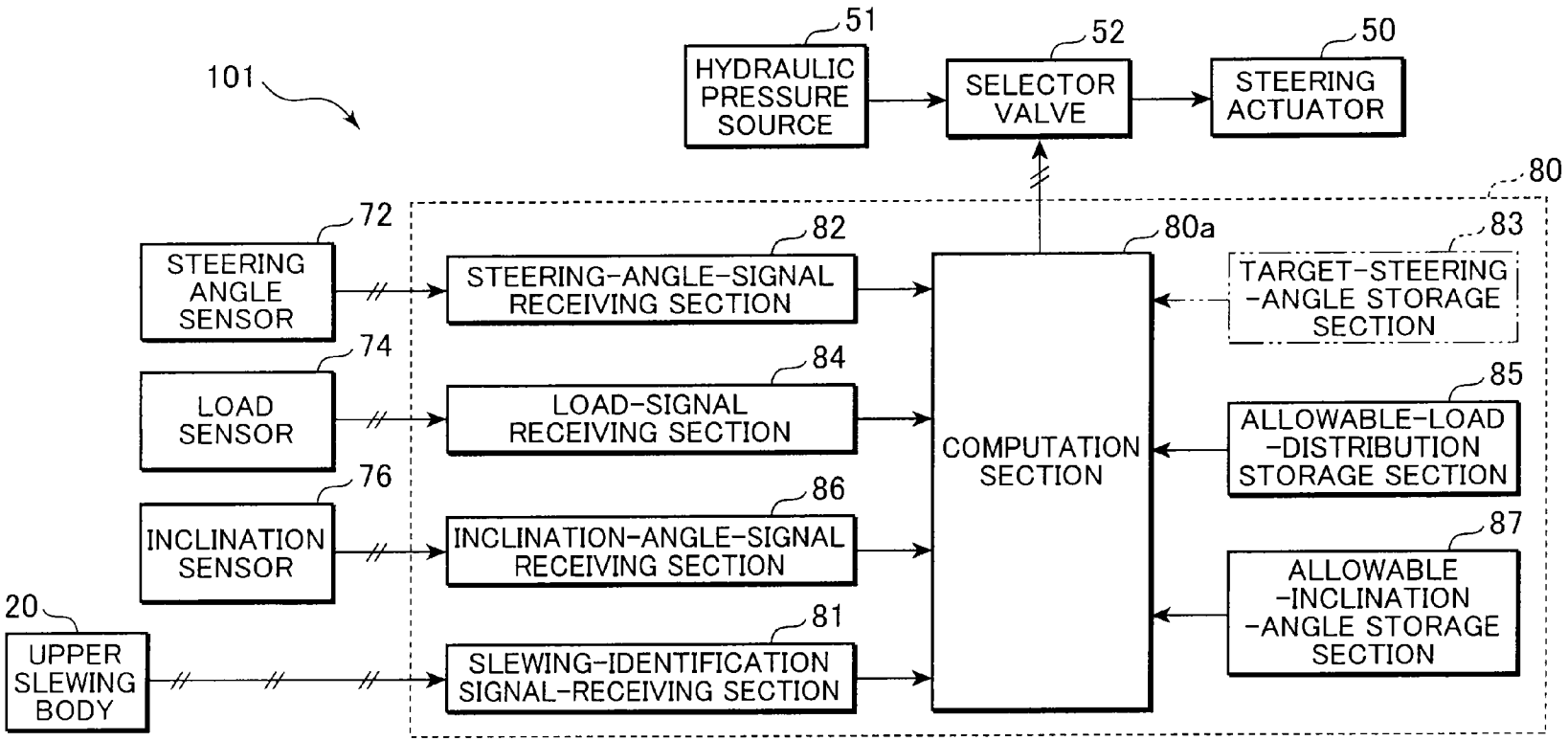
FIG. 6 is a block diagram of a steering control device according to a second embodiment of the present invention.

As shown in FIG. 6, the steering control device 101 according to the second embodiment includes a load sensor 74 and an inclination sensor 76, in addition to the steering angle sensor 72 in the first embodiment. The steering control device 101 includes a computation and control unit 80 which includes a load signal receiving section 84, an allowable-load-distribution storage section 85, an inclination-angle-signal receiving section 86 and an allowable-inclination-angle storage section 87, in addition to the computation section 80*a*, the slewing-identification-signal receiving section 81, the steering-angle-signal receiving section 82 and the target-steering-angle storage section 83, in the first embodiment.

The load sensor 74 is designed to detect a load applied to each of the wheels of the counterweight unit 30, and installed, for example, to a not-graphically-shown suspension device for the wheel 40. The load sensor 74 is operable to detect a load applied to the wheel 40, based on a hydraulic pressure of a damper included in the suspension device, or an expansion amount of the damper or a spring included in the suspension device. The load signal receiving section 84 receives a signal output from the load sensor 74, i.e., an information signal indicative of a load applied to each of the wheels 40, and input the received signal into the computation section 80*a*. The allowable-load-distribution storage section 85 stores therein a predetermined allowable value of a load distribution ununiformity degree indicative of a degree of ununiformity among respective loads applied to the wheels 40. Details of the load distribution ununiformity degree will be described later.

The inclination sensor 76 is operable to detect an inclination angle of the unit body 35 of the counterweight unit 30, specifically an inclination angle of the unit body 35 with respect to a normal line to the ground G. The inclination-angle-signal receiving section 86 receives a signal output from the inclination sensor 76, i.e., an information signal indicative of the inclination angle of the counterweight unit 30, and input the received signal into the computation section 80*a*. The allowable-inclination-angle storage section 87 stores therein a predetermined allowable value of the inclination angle of the counterweight unit 30.

Next will be described an operation of the steering control device 101 in the second embodiment, particularly a computation operation to be performed by the computation section 80*a* of the computation and control unit 80.

(1) Control based on Load Distribution Ununiformity Degree

Figure 9A:
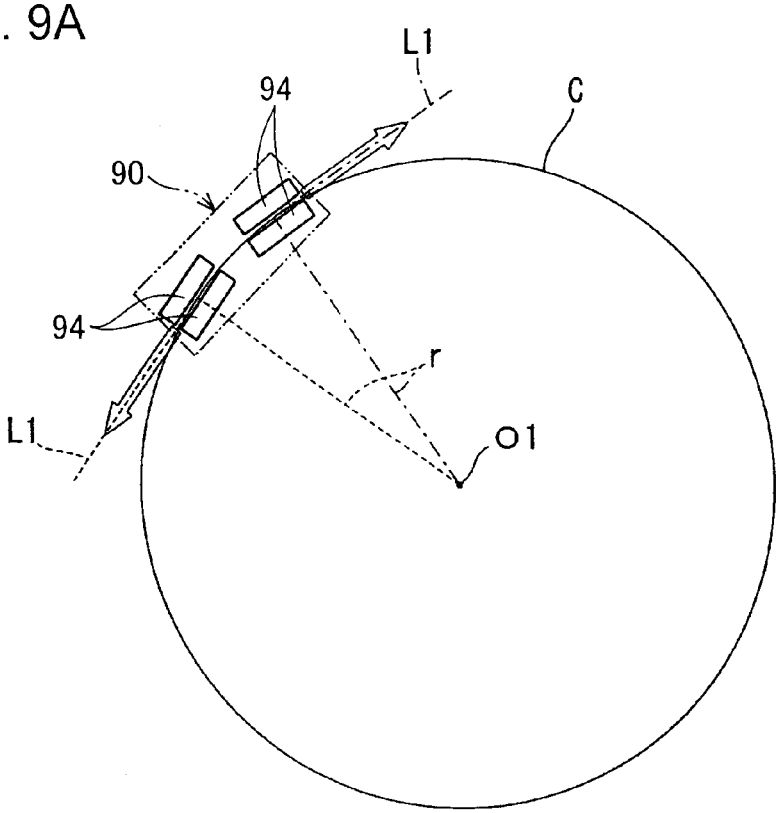
PRIOR ART FIG. 9A
FIG. 9A is a top plan view showing a traveling trajectory of a conventional counterweight unit.

As the turning radius r of the wheel 40 is increased accompanying turning travel of the counterweight unit 30 shown in FIG. 1, the counterweight unit 30 is increased inwardly, for example, similarly to the counterweight unit 90 shown in FIG. 9A, to bring respective loads applied to the wheels 40 into ununiformity. Hence, it is effective to control the steering angle θ of the wheel 40 based on a degree of the ununiformity of the loads.

In view of this, the computation section 80*a* of the computation and control unit 80 is configured to compute a load distribution ununiformity degree indicative of a degree of ununiformity among respective loads applied to the wheels 40, based on the load signal input from the load sensor 74 via the load signal receiving section 84, and then compare the calculated load distribution ununiformity degree with the allowable value of the load distribution ununiformity degree. Specifically, the load distribution ununiformity degree, for example, can be obtained by calculating a difference between a maximum one and a minimum one of respective loads applied to the wheels 40 may be calculated, or by calculating a difference between an average of the loads of all of the wheels 40 and the load of any one of the wheels 40, with respect to each of the wheels 40, and calculating the sum of the resulting differences. In concurrence with the above calculation, the computation section 80*a* reads the allowable value of the load distribution ununiformity degree stored in the allowable-load-distribution storage section 85 to compare the read allowable value with the calculated actual load distribution ununiformity degree, and controls the steering actuator 50 according to the resulting difference. Specifically, in the case of the actual load distribution ununiformity degree equal to or less than the allowable value, the computation and control unit 80 performs control of keeping the steering angle θ at zero degree, i.e., performs control of bringing an orientation of each of the wheels 40 in the front-rear direction into agreement with the orientation of the tangent L1 of the orbit C (FIG. 4); in the case of the actual load distribution ununiformity degree greater than the allowable value, the computation and control unit 80 performs control of correcting the steering angle θ of the wheel 40, e.g., correcting the steering angle θ to the target steering angle $\theta_0$ which is a predetermined adequate steering angle.

(2) Control Based on Inclination Angle

Since the counterweight unit 30 is inclined accompanying the increase in the turning radius r of the counterweight unit 30 shown in FIG. 1 as mentioned above, it is also effective to control the steering angle θ of the wheel 40 based on an inclination angle of the counterweight unit 30.

In view of this, the computation section 80*a* is configured to compare an actual inclination angle of the counterweight unit 30 obtained based on a signal input thereinto from the inclination sensor 76 via the inclination-angle-signal receiving section 86 with the allowable value of the inclination angle stored in the allowable-inclination-angle storage section 87, and to control the steering actuator 50 according to the resulting difference. Specifically, in the case of the actual inclination angle equal to or less than the allowable value, the computation and control unit 80 performs control of keeping the steering angle θ at zero degree, i.e., perform control of bringing an orientation of each of the wheels 40 in the front-rear direction into agreement with the tangent L1 of the orbit C (FIG. 4); in the case of the actual inclination angle greater than the allowable value, the computation and control unit 80 performs control of correcting the steering angle θ of the wheel 40, e.g., control of correcting the steering angle θ to the target steering angle $\theta_0$ which is a predetermined adequate steering angle.

In summary, the computation and control unit 80 according to the second embodiment performs a control of keeping the steering angle θ at zero degree in the case where the actual load distribution ununiformity degree and the actual inclination angle is equal to or less than a corresponding one of the predetermined allowable values, while performs control of correcting the actual steering angle θ of the wheel 40 to the predetermined target steering angle $\theta_0$ in the case where each of the actual load distribution ununiformity degree and the actual inclination angle is greater than the corresponding one of the predetermined allowable values. Furthermore, the computation and control unit 80 may be configured to perform control of making the steering angle θ be greater than the target steering angle $\theta_0$ by an amount increased with an increase in a difference between the actual load distribution ununiformity degree and the allowable value of the load distribution ununiformity degree or with an increase in a difference between the actual inclination angle and the allowable value of the inclination angle. Alternatively, the computation and control unit 80 may be configured to perform the control of the steering angle θ based on only one of two differences: the difference between the actual load distribution ununiformity degree and the allowable value of the load distribution ununiformity degree; and the difference between the actual inclination angle and the allowable value of the inclination angle.

Figure 9B:
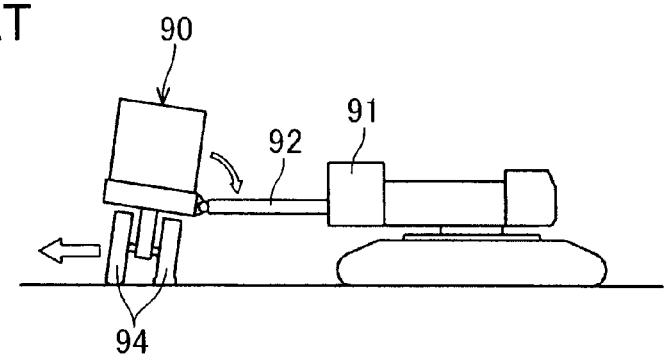
PRIOR ART FIG. 9B
FIGS. 9B and 9C are front views showing deformation of a wheel due to an increase in turning radius of the wheel in the conventional counterweight unit.
Figure 9C:
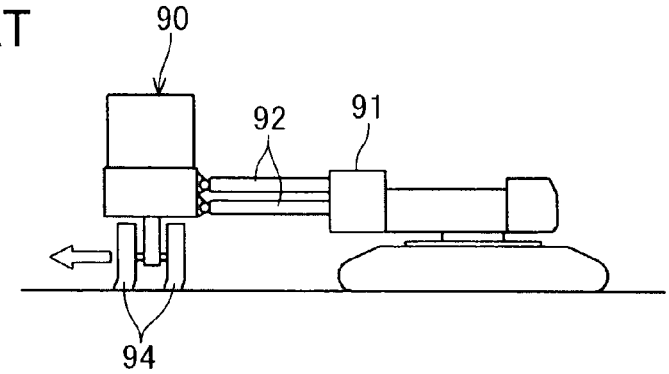
PRIOR ART FIG. 9C

The above control of the steering angle θ of the wheel 40 may involve excessive reduction in the turning radius r of the wheel 40 shown in FIGS. 4A and 4B; in this case, it is desirable to design the computation and control unit 80 to perform control of making the actual steering angle θ be smaller than the target steering angle $\theta_0$. The presence or absence of the excessive reduction in the turning radius r can be determined, for example, based on a detection signal output from the load sensor 74 and/or the inclination sensor 76. For example, the computation and control unit 80 can make judgment that the turning radius r is excessively reduced, when the inclination sensor 76 detects a reverse inclination to that due to the increase in the turning radius r of the wheel 40 (e.g., the inclination of the counterweight unit 90 shown in FIG. 9B), or when the load sensor 74 detects that a load applied to one of the wheels 40 located on a radially inward side with respect to the orbit C is less than a load applied to the other wheel 40 located on a radially outward side with respect to the orbit C. Besides, it is effective that at least one of the allowable-load-distribution storage section 85 and the allowable-inclination-angle storage section 87 stores therein an allowable value for determination on excessive reduction in the turning radius r, in addition to the allowable value for determination on excessive increase in the turning radius r.

The inclination of the unit body 35 of the counterweight unit 30 shown in FIG. 1 can be indirectly derived from a load distribution in the wheels 40. For example, the inclination of the unit body 35 can also be derived from a difference in load between the two wheels 40 located on respective inner and outer sides of the orbit C shown in FIGS. 4A and 4B, in a radial direction.

Alternatively, the steering control device 101 may be configured such that: in the case where the load distribution ununiformity degree of the wheels 40 of the counterweight unit 30 or the inclination angle of the unit body 35 of the counterweight unit 30 is equal to or less than a corresponding one of the allowable values, the steering control device 101 performs control of bringing the steering angle θ into agreement with the target steering angle $\theta_0$, similarly to the first embodiment; in the case of the load distribution ununiformity degree or the inclination angle is greater than the corresponding one of the allowable values, the steering control device 101 performs control of making the steering angle θ of the wheel 40 be greater than the target steering angle $\theta_0$ by an amount of the excess.

The above-mentioned control of the steering angle θ based on the load distribution ununiformity degree of each of the wheels 40 makes it possible to reliably suppress the ununiformity respective loads applied to the respective wheels 40 due to the increase in the turning radius r, and the control of the steering angle θ based on the inclination angle of the counterweight unit 30 makes it possible to reliably suppress the inclination of the counterweight unit 30 (particularly, the unit body 35 thereof) due to the increase in the turning radius r. In addition, the computation and control unit 80 thus configured to perform the control based on the actual load distribution ununiformity degree and/or the actual inclination angle can be widely applied to various cranes significantly different from each other in terms of a model or a radius of the counterweight unit 30, as compared to one configured to control the steering angle θ of the wheel 40 based on only the slewing direction of the upper slewing body 20.

Figure 7:
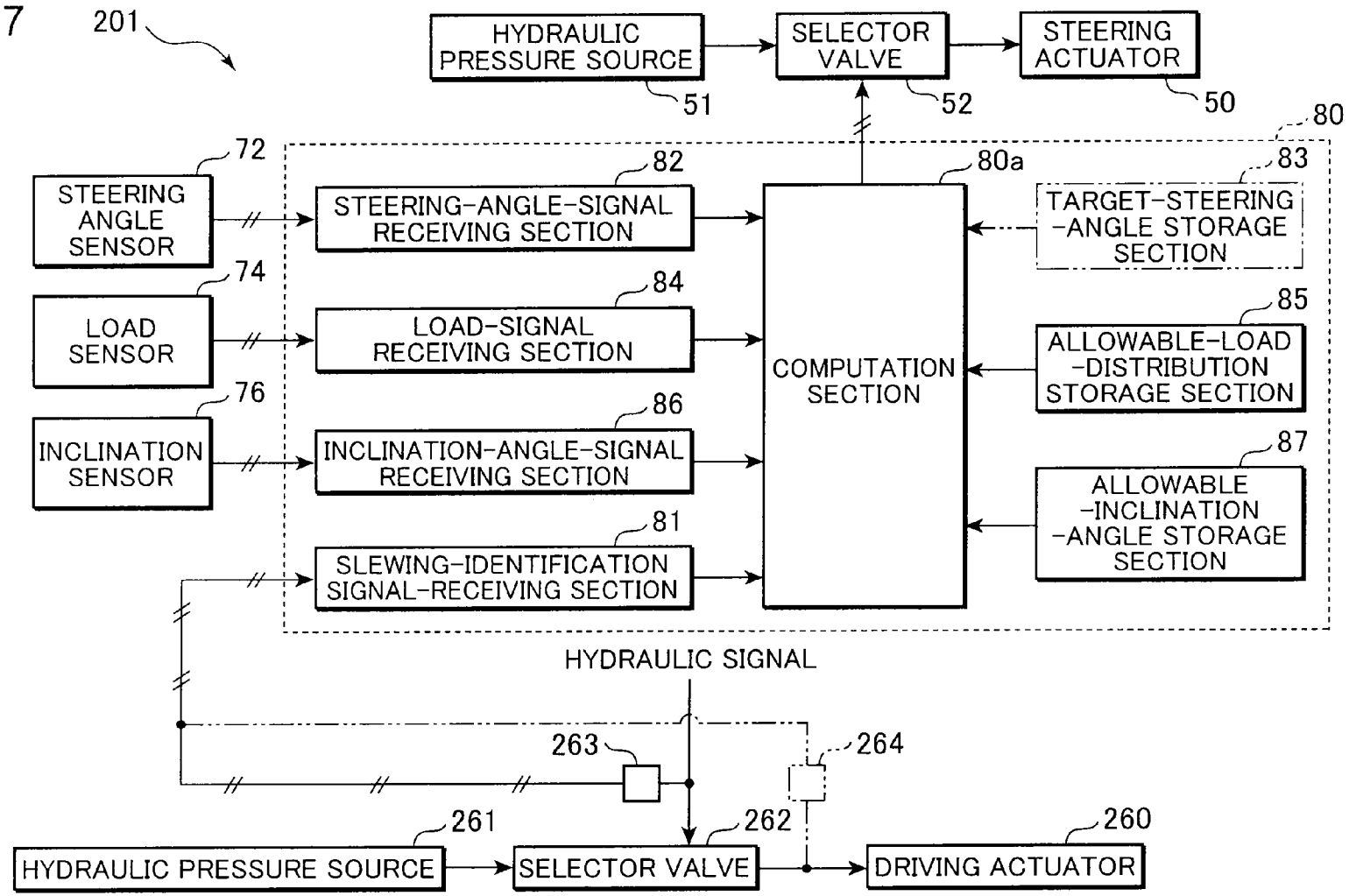
FIG. 7 is a block diagram of a steering control device according to a third embodiment of the present invention.

Next will be described a steering control device 201 according to the third embodiment of the present invention, with reference to FIG. 7. The steering control device 201 includes a driving actuator 260 for rotationally driving the wheels 40 by means of hydraulic pressure, in addition to the components of the steering control device 101 (shown in FIG. 6) in the second embodiment. In connection with the driving actuator 260, there are provided a plurality of sensors producing respective detection signals, which are input into the slewing-identification-signal receiving section 81 as signals for identifying the slewing direction or the turning direction. Details of the steering control device 201 are as follows.

In addition to the driving actuator 260, the steering control device 201 comprises a hydraulic pressure source 261 for supplying hydraulic pressure to the driving actuator 260, a selector valve 262 provided between the hydraulic pressure source 261 and the driving actuator 260, and a hydraulic-pressure-signal sensor 263.

The selector valve 262 is designed to switch between operation modes of the driving actuator 260. The selector valve 262 has a plurality of positions to be selected, and the selected positions are switched according to a hydraulic signal (pilot signal) input thereinto for an operation instruction of the driving actuator 260. The selector valve 262 is operable to switch supply/non-supply of hydraulic pressure from the hydraulic pressure source 261 to the driving actuator 260 and switch supply directions of hydraulic pressure, i.e., switching driving directions of the wheels 40 by the driving actuator 260, by switching the selected position.

The driving actuator 260 is formed of a hydraulic actuator adapted to be driven by hydraulic pressure supplied from the hydraulic pressure source 261, e.g., a hydraulic motor, and attached to the unit body 35 of the counterweight unit 30 shown in FIG. 1. The driving actuator 260 rotationally drives the wheels 40 in a direction corresponding to the selected position of the selector valve 262, and stops the driving.

The rotational driving of the wheels 40 by the driving actuator 260 causes the counterweight unit 30 to travel (be self-propelled) in a clockwise or counterclockwise turning direction in top plan view, as shown in FIGS. 4A and 4B. In the steering control device 201, the operation instruction hydraulic signal to be input into the driving actuator 260 shown in FIG. 7 is therefore utilizable as a slewing identification signal for identifying the slewing direction of the upper slewing body 20. In view of this, the hydraulic-pressure-signal sensor 263 is configured to convert the operation instruction hydraulic signal to be input into the driving actuator 260 to an electric signal, and input the resulting electric signal into the slewing-identification-signal receiving section 81, as a slewing identification signal which is an electric signal for identifying the slewing direction of the upper slewing body 20.

As well as the above hydraulic signal, the direction of supply of the hydraulic pressure to the driving actuator 260 is also useful as information for identifying the slewing direction. Therefore, in place of (or in addition to) the hydraulic-pressure-signal sensor 263, a driving hydraulic pressure sensor 264 for detecting the supply direction of hydraulic pressure from the selector valve 262 to the driving actuator 260, as indicated by the two-dot chain line, may be used. The driving hydraulic pressure sensor 264 is operable to produce an electric signal for enabling the slewing direction of the upper slewing body 20 to be identified, based on a supply direction of a driving hydraulic pressure to the driving actuator 260, and input the resulting electric signal to the slewing-identification-signal receiving section 81.

In the steering control device according to the third embodiment, the device including an hydraulic pressure sensor such as the hydraulic-pressure-signal sensor 263 and/or the driving hydraulic pressure sensor 264, the signals input into the slewing-identification-signal receiving section 81 are produced within the counterweight unit 30; therefore, there is no need for provide a new or additional signal line for connecting the upper slewing body 20 to the counterweight unit 30 in order to identify the slewing direction of the upper slewing body 20. Hence, the present invention can be applied to an existing crane 10 without any change, except the counterweight unit 30.

Figure 8:
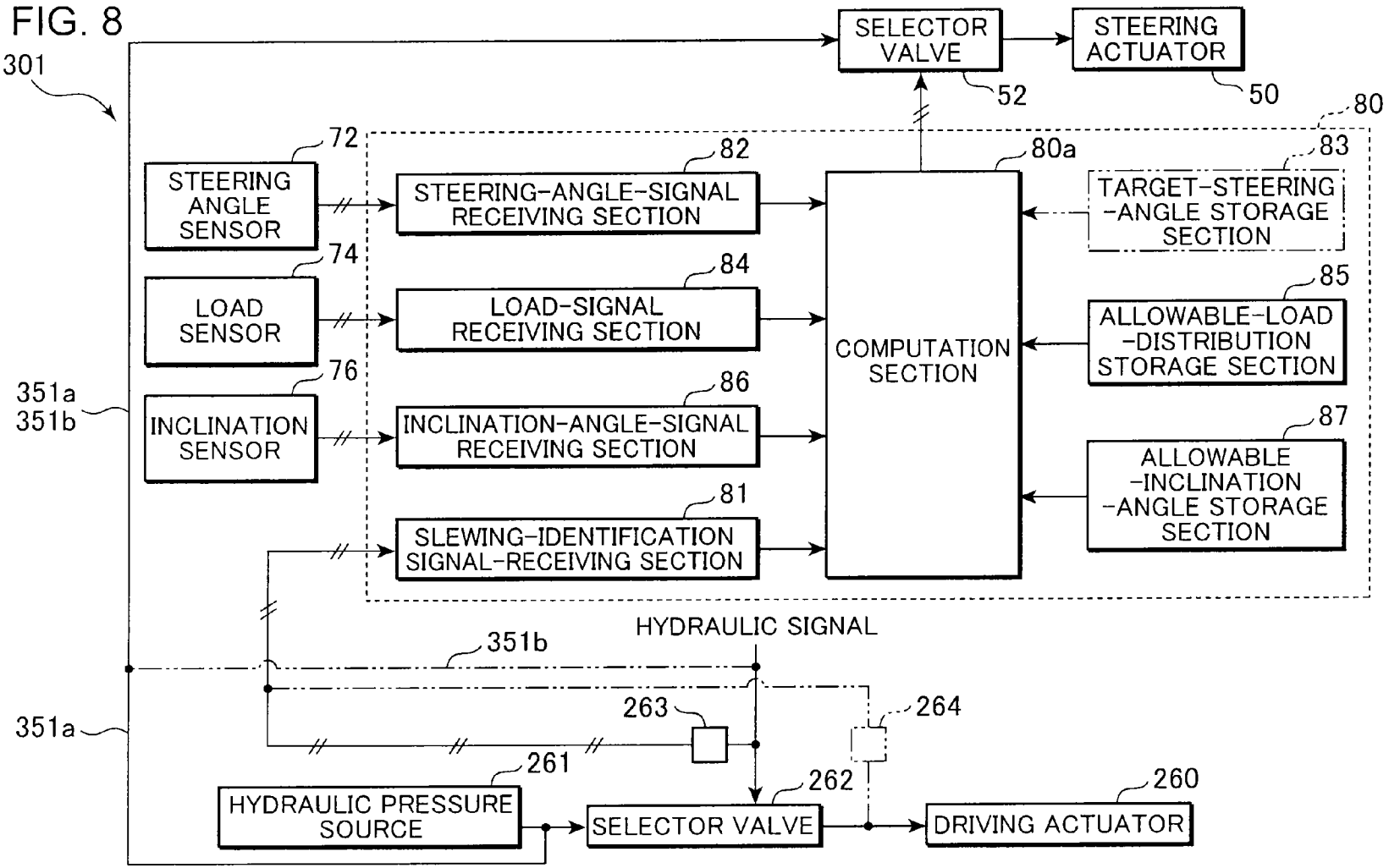
FIG. 8 is a block diagram of a steering control device according to a fourth embodiment of the present invention.

FIG. 8 shows a steering control device 301 according to a fourth embodiment of the present invention. While, in the steering control device 201 shown in FIG. 7, the hydraulic pressure is supplied to the steering actuator 50 from the hydraulic pressure source 51 different from the hydraulic pressure source 261 for the driving actuator 260, the hydraulic pressure source 261 for the driving actuator 260 in the steering control device 301 shown in FIG. 8, doubles a hydraulic pressure source for the steering actuator 50. In other words, the driving hydraulic pressure for the driving actuator 260 is used in parallel as a driving hydraulic pressure for the steering actuator 50. Specifically, the hydraulic pressure source 261 for the driving actuator 260 is connected to the selector valve 52 for the steering actuator 50 through a line 351.

In the steering control device 301 shown in FIG. 8, upon start of slewing of the upper slewing body 20 shown in FIG. 1, the driving actuator 260 and the steering actuator 50 are activated and controlled so as to bring an actual steering angle θ of each of the wheels 40 into agreement with an adequate steering angle, for example, the target steering angle $\theta_0$. During this control, the selector valve 262 is opened to continue supply of hydraulic pressure from the hydraulic pressure source 261 to the driving actuator 260, while the selector valve 52 is closed to stop supply of hydraulic pressure from the hydraulic pressure source 261 to the steering actuator 50.

In the steering control device 301 in the fourth embodiment, utilizing the hydraulic pressure source 261 for the driving actuator 260 as a hydraulic pressure source driving for the steering actuator 50 allows the configuration and operation of the steering control device 301 to be simplified; alternatively, for example, utilizing an operation instruction hydraulic pressure for the driving actuator 260 as a driving hydraulic pressure for the steering actuator 50 may also allow the configuration and operation of the device to be simplified. This utilization can be achieved, for example, by connecting a line of the hydraulic signal to be input into the selector valve 262 to the selector valve 52 through a line 351*b* indicated by the two-dot chain line in FIG. 8. Although this case includes a possibility of insufficiency of power for driving the steering actuator 50 due to a low hydraulic pressure supplied to the steering actuator 50 as compared to the fourth embodiment, the insufficiency of driving power can be covered up, for example, by: using a booster to increase a hydraulic pressure to be supplied to the steering actuator 50; using a hydraulic cylinder having an increased cylinder bore size as the steering actuator 50; or interconnecting the steering actuator 50 and the wheels 40 through a booster link or the like.

It is to be understood that the present invention is not limited to the above embodiments, but may encompass, for example, the following changes and modifications.

The electric circuit and the hydraulic circuit included in the steering control device may be variously changed to an extent capable of obtaining the same effects. For example, a hydraulic signal may be appropriately replaced with an electric signal. If the instruction hydraulic signal for the selector valve 262 shown in FIG. 8 is replaced with an electric signal, it becomes possible to directly input the electric signal into the slewing-identification-signal receiving section 81, while omitting the sensors 263, 264.

The adequate steering angle θ of the wheel 40 to be controlled by the computation and control unit 80 shown in FIG. 3, etc., may be set, for example, in the following manner.

(a) A steering angle θ corresponding to a maximum weight applied to the wheel 40, i.e., a weight of the unit body 35 shown in FIG. 1, may be stored in the target-steering-angle storage section 83 as the target steering angle $\theta_0$.

(b) It is also possible to detect a level of load applied to the wheel 40 and control the steering angle θ according to the detected level. The load applied to the wheel 40 can be detected, for example, by a load cell for detecting a tension of the hanger rope 31 shown in FIG. 1, or the load sensor 74 shown in FIG. 6.

(c) The target steering angle $\theta_0$ depending on the turning radius r shown in FIGS. 4A and 4B may be stored in the target-steering-angle storage section 83 in the form, for example, of a map or a table.

(d) It is also possible to detect the turning radius r to control the steering angle θ according to the detected turning radius. The turning radius r can be detected, for example, by a length sensor for detecting a length of the unit-body connection member 32 shown in FIG. 1, or can be calculated, for example, based on a raising/lowering angle of the first mast 22 shown in FIG. 1.

(e) The target steering angle $\theta_0$ may be predetermined depending on a speed of turning traveling (e.g., a maximum speed or an average speed during turning traveling) of the counterweight unit 30 shown in FIG. 1.

(f) It is also possible to detect a rotational speed of the wheel 40 and/or a slewing speed of the upper slewing body 20 by a sensor and control the steering angle θ according to the result of the detection.

(g) It is also possible to detect an internal pressure of the wheel 40 and control the steering angle θ according to the calculated ground contact length Lc of the wheel 40 shown in FIG. 5B based on the result of the detection.

As described above, according to the invention, there is provided a crane equipped with a counterweight unit including a plurality of wheels to be capable of travelling on the ground in a turning direction, the crane being capable of suppressing an increase in a slewing radius of the wheels to enhance the operation efficiency of the crane. The provided crane comprises: a lower body; an upper slewing body mounted on the lower body so as to be slewable; a counterweight unit including a plurality of wheels each being rollable on the ground and having a variable steering angle, the counterweight unit being capable of travelling on the ground with respective rolling motions of the wheels, in a turning direction equal to a slewing direction of the upper slewing body, in a state of being suspended from the upper slewing body; a steering actuator adapted to rotate the wheels around a steering-rotation center axis to change a steering angle thereof; and a steering control device for controlling an operation of the steering actuator. The steering control device includes a slewing-identification-signal receiving section receives a slewing identification signal to enable a slewing direction of the upper slewing body to be identified and an actuator operating section operates the steering actuator so as to orient the wheels to the inside of a tangent line on the steering-rotation center axis of the wheels to an orbit of the counterweight unit, based on the slewing direction identified by the slewing identification signal.

The steering control device of the present invention, thus orienting each of the wheels of the counterweight unit to the inside of the tangent line to the orbit of the wheel, can suppress the increase in the turning radius of the wheel during turning traveling of the counterweight unit, thereby enabling the efficiency of crane operations to be improved.

In a preferred embodiment of the present invention, the steering control device further includes a target-steering-angle storage section which stores therein a target steering angle of each of the wheels, the target steering angle predetermined correspondingly to the slewing direction of the upper slewing body, wherein the actuator operating section operates the steering actuator so as to bring the steering angle of the wheel into with the target steering angle stored in the target-steering-angle storage section. In this embodiment, the control of the operation of the steering actuator for the agreement of the steering angle of the wheel with the predetermined target steering angle allows the computation and control operations of the steering control device to be simplified as compared with the case of calculating the target steering angle during turning operation on a real-time basis.

It is preferable that the steering control device further includes: a load signal receiving section which receives a load signal which is a signal indicative of information about respective loads of the wheels; and an allowable-load-distribution storage section which stores therein a predetermined allowable value of a load distribution ununiformity degree indicative of a degree of ununiformity among respective loads applied to the wheels, wherein the actuator operating section is operable to control the operation of the steering actuator according to a difference between a load distribution ununiformity degree derived from the load signal received by the load signal receiving section, and the allowable value of the load distribution ununiformity degree stored in the allowable-load-distribution storage section. The steering control device controls the steering angle of each of the wheels based on the load distribution ununiformity degree which increases in response to an increase in the turning radius of the wheel, thereby performing a suitable steering control for suppressing the increase in the turning radius.

More specifically, it is preferable that the steering control device, for example, further includes a target-steering-angle storage section which stores therein a target steering angle of each of the wheels predetermined correspondingly to the slewing direction of the upper slewing body, wherein the actuator operating section performs control of keeping the steering angle of each of the wheels at zero when the load distribution ununiformity degree derived from the load signal received by the load signal receiving section is equal to or less than the allowable value of the load distribution ununiformity degree stored in the allowable-load-distribution storage section, while the actuator operating section operates the steering actuator so as to make the steering angle of each of the wheels be equal to or greater than the target steering angle stored in the target-steering-angle storage section when the load distribution ununiformity degree derived from the load signal received by the load signal receiving section is greater than the allowable value of the load distribution ununiformity degree stored in the allowable-load-distribution storage section.

In this case, the actuator operating section may be configured such that, when the load distribution ununiformity degree derived from the load signal received by the load signal receiving section is greater than the allowable value of the load distribution ununiformity degree stored in the allowable-load-distribution storage section, the actuator operating section operates the steering actuator so as to make the steering angle of each of the wheels be greater than the target steering angle by an amount corresponding to the difference between the load distribution ununiformity degree derived from the load signal and the allowable value of the load distribution ununiformity degree stored in the allowable-load-distribution storage section. This allows the steering control more suitable for an actual load distribution ununiformity degree to be realized.

Alternatively, it is also preferable that: the steering control device further includes a target-steering-angle storage section which stores therein a target steering angle of each of the wheels predetermined correspondingly to the slewing direction of the upper slewing body; and the actuator operation section operates the steering actuator so as to bring the steering angle of each of the wheels into agreement with the target steering angle stored in the target-steering-angle storage section when the load distribution ununiformity degree derived from the load signal received by the load signal receiving section is equal to or less than the allowable value of the load distribution ununiformity degree stored in the allowable-load-distribution storage section, while the actuator operation section operates the steering actuator operates the steering actuator so as to make the steering angle of each of the wheels be greater than the target steering angle by an amount corresponding to the difference between the load distribution ununiformity degree derived from the load signal and the allowable value of the load distribution ununiformity degree stored in the allowable-load-distribution storage section when the load distribution ununiformity degree derived from the load signal received by the load-signal receiving section is greater than the allowable value of the load distribution ununiformity degree stored in the allowable-load-distribution storage section. This also allows a control suitable for an actual load distribution ununiformity degree and effective in suppressing an increase in the turning radius of the wheel to be realized.

It is also preferable that the steering control device further includes: a inclination-angle-signal receiving section which receives an inclination angle signal which is a signal indicative of information about a inclination angle of the counterweight unit with respect to a direction of a turning radius of the counterweight unit; and an allowable-inclination-angle storage section which stores therein a predetermined allowable value of the inclination angle, wherein the actuator operating section controls the operation of the steering actuator according to a difference between an inclination angle derived from the inclination angle signal received by the inclination-angle-signal receiving section and the allowable value of the inclination angle stored in the allowable-inclination-angle storage section. This steering control device, adapted to control the steering angle of each of the wheels based on the inclination angle of the counterweight unit with respect to a direction of the turning radius which increases in response to an increase in the turning radius of the wheel, can perform the steering control suitable for suppression of an increase in the turning radius.

More specifically, it is preferable that the steering control device, for example, further includes a target-steering-angle storage section which stores therein a target steering angle of each of the wheels predetermined correspondingly to the slewing direction of the upper slewing body, wherein: the actuator operating section performs control of keeping the steering angle of each of the wheels at zero, when the inclination angle derived from the inclination angle signal received by the inclination-angle-signal receiving section is equal to or less than the allowable value of the inclination angle stored in the allowable-inclination-angle storage section; and the actuator operating section operates the steering actuator so as to make the steering angle of each of the wheels be equal to or greater than the target steering angle stored in the target-steering-angle storage section, when the inclination angle derived from the inclination angle signal received by the inclination-angle-signal receiving section is greater than the allowable value of the inclination angle stored in the allowable-inclination-angle storage section.

In this case, the actuator operating section may be configured such that, when the inclination angle derived from the inclination angle signal received by the inclination-angle-signal receiving section is greater than the allowable value of the inclination angle stored in the allowable-inclination-angle storage section, the actuator operating section operates the steering actuator so as to make the steering angle of each of the wheels be greater than the target steering angle by an amount corresponding to the difference between the inclination angle derived from the inclination angle signal and the allowable value of the inclination angle stored in the allowable-inclination-angle storage section. This also allows a control suitable for an actual inclination angle and effective in suppressing an increase in the turning radius of the wheel to be realized.

Alternatively, it is also preferable that: the steering control device further includes a target-steering-angle storage section which stores therein a target steering angle of each of the wheels predetermined correspondingly to the slewing direction of the upper slewing body; the actuator operating section operates the steering actuator so as to bring the steering angle of each of the wheels into agreement with the target steering angle stored in the target-steering-angle storage section, when the inclination angle derived from the inclination angle signal received by the inclination-angle-signal receiving section is equal to or less than the allowable value of the inclination angle stored in the allowable-inclination-angle storage section; and the actuator operating section operates the steering actuator so as to make the steering angle of each of the wheels be greater than the target steering angle by an amount corresponding to the difference between the inclination angle derived from the inclination angle signal and the allowable value of the inclination angle stored in the allowable-inclination-angle storage section, when the inclination angle derived from the inclination angle signal received by the inclination-angle-signal receiving section is greater than the allowable value of the inclination angle stored in the allowable-inclination-angle storage section. This also allows a control suitable for an actual inclination angle and effective in suppressing an increase in the turning radius of the wheel.

In the present invention, the signal to be input into the slewing-identification-signal receiving section of the steering control device may be an electric signal output from the upper slewing body.

In the case of the crane further comprising a driving actuator for rotationally driving the wheels and a hydraulic pressure sensor for producing an electric signal based on a hydraulic pressure serving as an operation instruction or a driving force for the driving actuator, the electric signal produced by the hydraulic pressure sensor may be input into the slewing-identification-signal receiving section of the steering control device.

In the case of the crane further comprising a driving actuator for rotationally driving the wheels and a hydraulic pressure source for actuating the driving actuator, the hydraulic pressure source may double a hydraulic pressure source for actuating the steering actuator. This makes it possible to simplify configuration and operation of the steering control device.

Similarly, in the case of the crane further comprising a driving actuator which operates so as to rotationally drive the wheels by receiving an input of a hydraulic signal, the hydraulic signal may be used as a hydraulic pressure for actuating the steering actuator. This allows configuration and operation of the steering control device to be simplified.

This application is based on Japanese Patent application No. 2011-240196 filed in Japan Patent Office on Nov. 1, 2011, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A crane comprising:

a lower body;

an upper slewing body mounted on the lower body so as to be slewable;

a counterweight unit including a plurality of wheels each being rollable on the ground and having a variable steering angle, the counterweight unit being capable of travelling on the ground with respective rolling motions of the wheels, in a turning direction equal to a slewing direction of the upper slewing body, in a state of being suspended from the upper slewing body;

a steering actuator adapted to rotate the wheels around a steering-rotation center axis to change the steering angle thereof;

and a steering control device for controlling an operation of the steering actuator, the steering control device including a slewing-identification-signal receiving section which receives a slewing identification signal to enable a slewing direction of the upper slewing body to be identified, and an actuator operating section which operates the steering actuator when the upper slewing body is slewed involving the traveling of the counterweight unit in the turning direction, based on an orbit of the counterweight unit, so as to make a line along a traveling direction of the wheels to be inwardly inclined to a tangent line located on the steering-rotation center axis of the wheels, the tangent line being tangent to the orbit of the counterweight unit traveling in the turning direction, based on the slewing direction identified by the slewing identification signal; wherein said wheels travels inside or inwardly of said tangent line around the orbit in a clockwise and counter-clockwise direction.

2. The crane as defined in claim 1, wherein the steering control device further includes a target-steering-angle storage section which stores therein a target steering angle of each of the wheels predetermined correspondingly to the slewing direction of the upper slewing body, and wherein the actuator operating section operates the steering actuator so as to bring the steering angle of the wheel into agreement with the target steering angle stored in the target-steering-angle storage section.

3. The crane as defined in claim 1, wherein the steering control device further includes:

a load signal receiving section which receives a load signal which is a signal indicative of information about respective loads applied to the wheels; and an allowable-load-distribution storage section which stores therein a predetermined allowable value of a load distribution ununiformity degree indicative of a degree of ununiformity among respective loads applied to the wheels, and wherein the actuator operating section controls the operation of the steering actuator according to a difference between a load distribution ununiformity degree derived from the load signal received by the load signal receiving section, and the allowable value of the load distribution ununiformity degree stored in the allowable-load-distribution storage section.

4. The crane as defined in claim 3, wherein:

the steering control device further includes a target-steering-angle storage section which stores therein a target steering angle of each of the wheels predetermined correspondingly to the slewing direction of the upper slewing body;

the actuator operating section performs control of keeping the steering angle of each of the wheels at zero when the load distribution ununiformity degree derived from the load signal received by the load signal receiving section is equal to or less than the allowable value of the load distribution ununiformity degree stored in the allowable-load-distribution storage section; and the actuator operating section operates the steering actuator so as to make the steering angle of each of the wheels be equal to or greater than the target steering angle stored in the target-steering-angle storage section when the load distribution ununiformity degree derived from the load signal received by the load signal receiving section is greater than the allowable value of the load distribution ununiformity degree stored in the allowable-load-distribution storage section.

5. The crane as defined in claim 4, wherein when the load distribution ununiformity degree derived from the load signal received by the load signal receiving section is greater than the allowable value of the load distribution ununiformity degree stored in the allowable-load-distribution storage section, the actuator operating section operates the steering actuator so as to make the steering angle of each of the wheels be greater than the target steering angle by an amount corresponding to the difference between the load distribution ununiformity degree derived from the load signal and the allowable value of the load distribution ununiformity degree stored in the allowable-load-distribution storage section.

6. The crane as defined in claim 3, wherein the steering control device further includes a target-steering-angle storage section which stores therein a target steering angle of each of the wheels predetermined correspondingly to the slewing direction of the upper slewing body, and wherein the actuator operating section operates the steering actuator so as to bring the steering angle of each of the wheels into agreement with the target steering angle stored in the target-steering-angle storage section when the load distribution ununiformity degree derived from the load signal received by the load signal receiving section is equal to or less than the allowable value of the load distribution ununiformity degree stored in the allowable-load-distribution storage section, and the actuator operating section operates the steering actuator so as to make the steering angle of each of the wheels be greater than the target steering angle by an amount corresponding to the difference between the load distribution ununiformity degree derived from the load signal and the allowable value of the load distribution ununiformity degree stored in the allowable-load-distribution storage section when the load distribution ununiformity degree derived from the load signal received by the load-signal receiving section is greater than the allowable value of the load distribution ununiformity degree stored in the allowable-load-distribution storage section.

7. The crane as defined in claim 1, wherein the steering control device further includes:

an inclination-angle-signal receiving section which receives an inclination angle signal which is a signal indicative of information about an inclination angle of the counterweight unit with respect to a normal line to the ground in a direction of a turning radius of the counterweight unit; and an allowable-inclination-angle storage section which stores therein a predetermined allowable value of the inclination angle, and wherein the actuator operating section controls the operation of the steering actuator according to a difference between the inclination angle derived from the inclination angle signal received by the inclination-angle-signal receiving section and the allowable value of the inclination angle stored in the allowable-inclination-angle storage section.

8. The crane as defined in claim 7, wherein the steering control device further includes a target-steering-angle storage section which stores therein a target steering angle of each of the wheels, the target steering angle being predetermined correspondingly to the slewing direction of the upper slewing body, and wherein the actuator operating section performs control of keeping the steering angle of each of the wheels at zero, when the inclination angle derived from the inclination angle signal received by the inclination-angle-signal receiving section is equal to or less than the allowable value of the inclination angle stored in the allowable-inclination-angle storage section and, the actuator operating section operates the steering actuator so as to make the steering angle of each of the wheels be equal to or greater than the target steering angle stored in the target-steering-angle storage section, when the inclination angle derived from the inclination angle signal received by the inclination-angle-signal receiving section is greater than the allowable value of the inclination angle stored in the allowable-inclination-angle storage section.

9. The crane as defined in claim 8, wherein when the inclination angle derived from the inclination angle signal received by the inclination-angle-signal receiving section is greater than the allowable value of the inclination angle stored in the allowable-inclination-angle storage section, the actuator operating section operates the steering actuator so as to make the steering angle of each of the wheels be greater than the target steering angle by an amount corresponding to the difference between the inclination angle derived from the inclination angle signal and the allowable value of the inclination angle stored in the allowable-inclination-angle storage section.

10. The crane as defined in claim 7, wherein the steering control device further includes a target-steering-angle storage section which stores therein a target steering angle of each of the wheels predetermined correspondingly to the slewing direction of the upper slewing body;

the actuator operating section operates the steering actuator so as to bring the steering angle of each of the wheels into agreement with the target steering angle stored in the target-steering-angle storage section when the inclination angle derived from the inclination angle signal received by the inclination-angle-signal receiving section is equal to or less than the allowable value of the inclination angle stored in the allowable-inclination-angle storage section the actuator operating section operates the steering actuator so as to make the steering angle of each of the wheels be greater than the target steering angle by an amount corresponding to the difference between the inclination angle derived from the inclination angle signal and the allowable value of the inclination angle stored in the allowable-inclination-angle storage section when the inclination angle derived from the inclination angle signal received by the inclination-angle-signal receiving section is greater than the allowable value of the inclination angle stored in the allowable-inclination-angle storage section.

11. The crane as defined in claim 1, wherein the signal to be input into the slewing-identification-signal receiving section of the steering control device is an electric signal output from the upper slewing body.

12. The crane as defined in claim 1, which further comprises a driving actuator for rotationally driving the wheels, and a hydraulic pressure sensor for producing an electric signal based on a hydraulic pressure serving as an operation instruction or a driving force for the driving actuator, wherein the signal to be input into the slewing-identification-signal receiving section of the steering control device is an electric signal produced by the hydraulic pressure sensor.

13. The crane as defined in claim 1, which further comprises a driving actuator for rotationally driving the wheels, and a hydraulic pressure source for actuating the driving actuator, wherein the hydraulic pressure source doubles a hydraulic pressure source for actuating the steering actuator.

14. The crane as defined in claim 1, which further comprises a driving actuator which rotationally drives the wheels by receiving an input of a hydraulic signal, wherein the hydraulic signal is used as a hydraulic pressure for actuating the steering actuator.

15. The crane as defined in claim 1, wherein the steering control device adjusts an angle between the line along the traveling direction of the wheels and the tangent line located on the steering-rotation center axis of the wheels based on a ground contact length of the wheels.

* * * * *